United States Patent [19]

Glass

[11] Patent Number: 4,586,871

[45] Date of Patent: May 6, 1986

[54] SHAFTLESS TURBINE

[76] Inventor: Benjamin G. Glass, 3011 Stockett Way, San Diego, Calif. 92117

[21] Appl. No.: 188,988

[22] Filed: Sep. 22, 1980

[51] Int. Cl.[4] ..... F01D 1/36

[52] U.S. Cl. ..... 415/90; 415/202

[58] Field of Search ..... 415/90, 98, 76, 202; 416/184

[56] References Cited

U.S. PATENT DOCUMENTS

| | | | |
|---|---|---|---|
| 1,139,562 | 5/1915 | Nash | 415/90 |
| 4,232,992 | 11/1980 | Possell | 415/90 |
| 4,280,791 | 7/1981 | Gawne | 415/90 |

*Primary Examiner*—Robert E. Garrett
*Assistant Examiner*—Joseph M. Pitko
*Attorney, Agent, or Firm*—Penrose Lucas Albright

[57] ABSTRACT

A turbine has a disc pack rotor with a central aperture-free or solid disc that divides the pack into two equal portions. The annular discs of each portion have aligned, central and unobstructed exhaust openings and the outer end disc of each portion is a support member having a webbed hub that is attached to a respective drive shaft journalled in the turbine casing. A stationary circular nozzle assembly closely surrounds the outer circumference of the disc pack to form one or more convergent-divergent nozzles that guide motivating fluid from an outer casing plenum into spaces between neighboring discs. The discs are separated from one another and interconnected by fences that guide the motivating fluid to the exhaust openings in each pack portion. Thus, fluid enters the pack circumference and is split into two parts by the center disc to exhaust in relatively opposite directions. The shaft for each pack portion preferably terminates at the outer support disc to form a two-direction "shaftless" rotor.

10 Claims, 6 Drawing Figures

FIG. 1
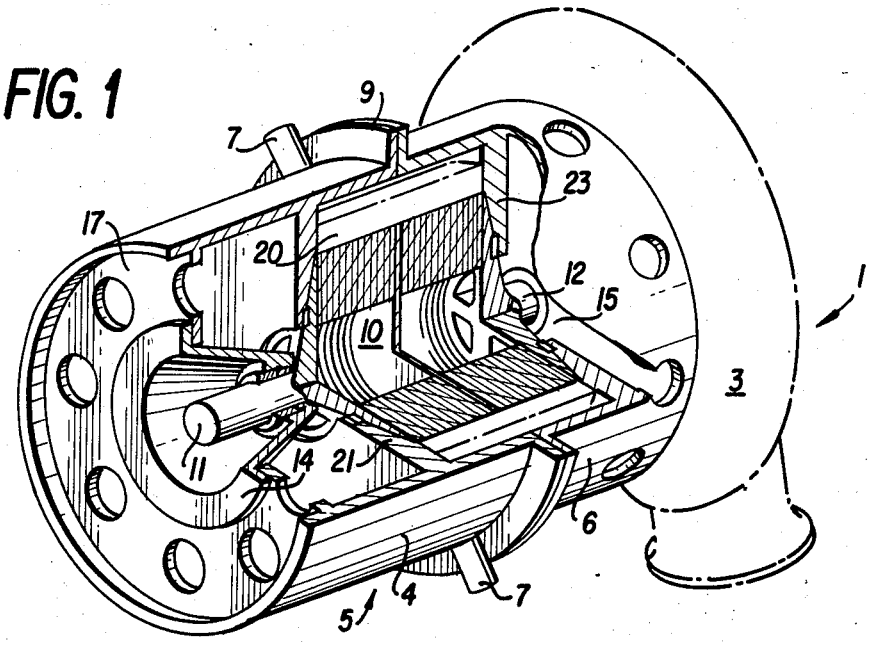
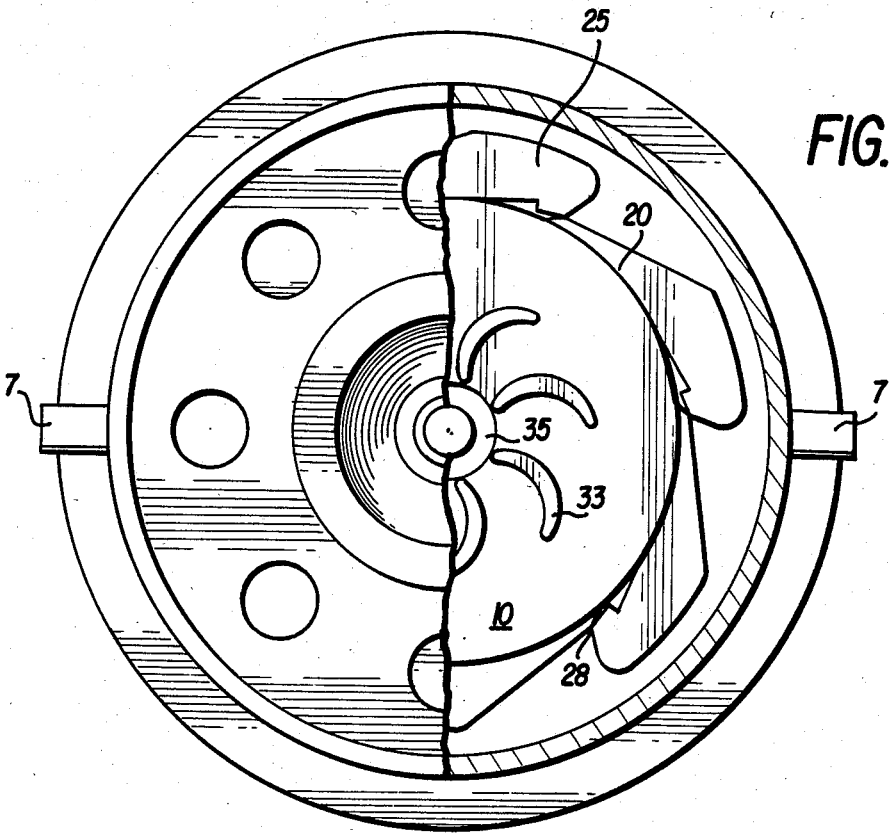
FIG. 3

SHAFTLESS TURBINE

Efficient disc turbomachinery requires that its structure be as compact as possible without sacrifices in energy use, reliability, maintainability and longevity. With the present invention all these advantages are attained in greater measure than with previous designs.

It is an object of this invention to reduce turbine or pump size by attaining higher R.P.M. yet maintain rotating material stresses well within present limitations.

It is a further object to improve motivating fluid flow passages and eliminate unnecessary pressure losses.

The disc construction disclosed in my earlier U.S. Pat. No. 4,036,584 introduced disc rotor construction eliminating both bolting or spoke-like ties to a central clamping shaft and bonded discs together via spiral-like fences thus eliminating discontinuity disc regions caused by bolt holes which lower R.P.M. capability due to excessive centrifugal local stress concentrations.

Constant thickness discs fail at R.P.M./diameter relations much lower than those attained by conventional bladed turbine rotors in identical material specifications because rotors are tapered outwards parabolically from hubs providing approximately constant stress from boss to perimeter. This invention achieves improved results by providing hollow discs from hub rims outside diameter to disc perimeter where hollow void is sealed by a circumferential band or hoop tying front and back faces.

This composite disc hollow construction can also be very advantageously applied to the aperture-free, center which directs the forward and aft flow of the turbine fluid because the additional structural strength thus obtained reinforces the disc packs fore and aft to which it attaches.

Split flow attained by the solid aperture-free central disc enables greater mass flow capacity without increase in either disc outside diameter or exhaust orifice diameter because effective duct passages are halved and adequate exhaust area is provided at each turbine end in place of conventional single end exhaust turbines.

The present invention ensures motivating fluid low pressure drop entries by a plenum feeding longitudinal nozzle members shaped to form convergent/divergent surfaces thus avoiding abrupt flow direction changes and delivering rotor span-wise continuous flow. When conical shaped discs are used, longitudinal straight, convergent/divergent nozzle members can be replaced with helical shaped nozzle orifices as viewed in turbine side elevational view.

FIG. 1 is a perspective view of the turbine with part in section;

FIG. 3 is a side elevation of the FIG. 1 turbine taken along the lines 3—3;

Figure 4:
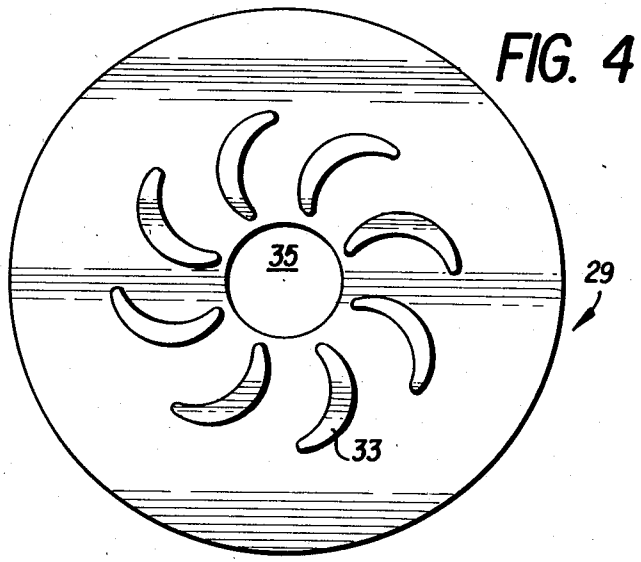
FIG. 4 is an elevation of the disc with fence structure.

As stated above, in U.S. Pat. No. 3,036,584, a shaftless turbine rotor is described in which discs are separated from one another by spiral fences that guide motivating fluid towards a central exhaust opening.

The present invention is directed to a turbine in which a rotor disc pack is split into two portions by a central solid plate so that motivating fluid is exhausted from the center of the pack in relatively opposite directions. Each pack portion is connected to a respective shaft journalled in the turbine casing and the shafts preferably terminate adjacent the outer ends of the pack leaving central exhause openings unobstructed. A stationary ring nozzle surrounds the rotor discs and directs motivating fluid between the discs' outer peripheries. Inner fences between the discs, separate neighboring discs and provide ties between the discs. The fences guide fluid to exhaust passageways and afford additional surfaces for motivating fluid.

In FIG. 1, the turbine 1 has at each end, a vacuum end casing support 3 with a housing portion 5 that is formed of two segments 4 and 6 and diametrically opposed fluid entries 7 at the flange joint 9 (FIG. 3). The entries 7 can be pipes tangential or normal to the casing surface. Only one end casing support 3 is shown for clarity. Also, the structural details of one end of the rotor end connections are shown in FIG. 1. The rotor assembly includes a rotor 10 with stub shafts 11 and 12 that are journalled to cones 14 and 15 of the segments 4 and 6, respectively. The cones 14 and 15 are bolted to apertured end web plates 17 and 18 and inner web plates 21 and 23 house the rotor 10 and ring nozzle 20.

Figure 2:
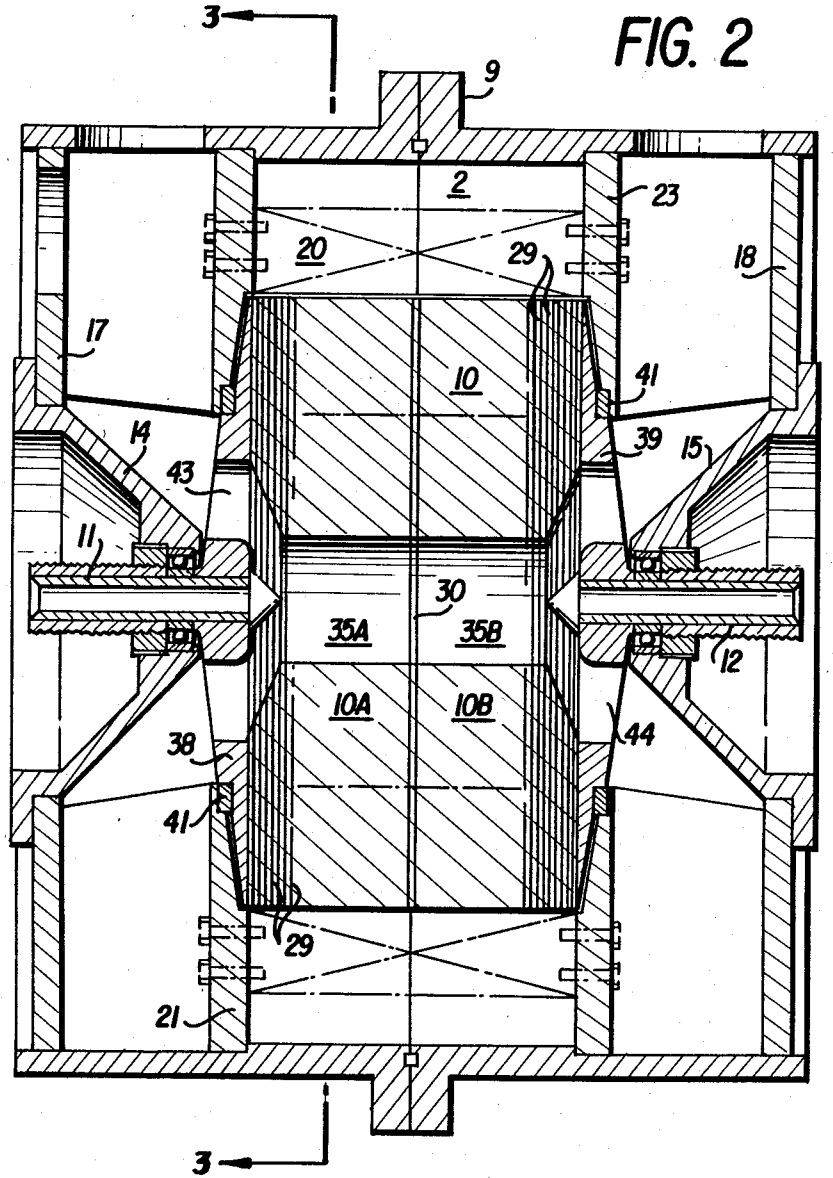
FIG. 2 is a front view in section of the split rotor supported within the turbine casing.

As seen in FIGS. 2 and 3, the nozzle 20 is bolted to plates 21 and 23 and preferably includes six segments 25 arranged around the rotor 10 which form six motivating fluid entry convergent/divergent nozzles with throats leading into the rotor. The rotor 10 is made of a pack of spaced-apart discs 29 that are divided into two portions 10A and 10B by a central solid flat plate 30. The discs 29 are cone-shaped and except for the fencing arrangement, the same as discs 20 in FIG. 7 of U.S. Pat. No. 4,036,584. In the instant structure, flow fences 33 are preferably the only ties between the discs 29. The fences 33 are curved flat strips located near the central hole 35 for each disc 29 and the holes 35 of the portions 10A and 10B are aligned to form fluid exhaust passageways 35A and 35B at opposite sides of plate 30. Apertured end plates 38 and 39 for portions 10A and 10B, respectively, are fixed to shafts 11 and 12.

The rotor 10 is sealed by ring seals 41 in plates 21 and 23 to prevent fluid leakage. The seals 41 can be graphite and spider hubs 43 and 44 in end plates 38 and 39 connect the rotor 10 to shafts 11 and 12 while allowing fluid exhaust from passageways 35A and 35B.

The discs 29 in FIG. 4 are similar to the conical discs of U.S. Pat. No. 4,036,584 except the fences 33 are relatively short streamlined strips and located near the central openings 35. The fences 33 are brazed, welded or otherwise joined to the neighboring discs 29 and to end plates 38 and 39 so that each disc braces the entire rotor pack and the center plate 30, not having any hole in the highly stressed center results in a superior load carrying capacity. The absence of clamping holes or bolt holes enables the rotor pack to achieve higher speeds than would be possible otherwise if stress inducing bolts and holes were present.

Figure 5:
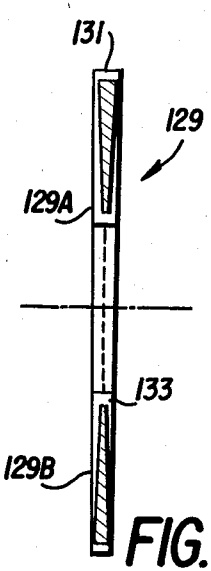
FIG. 5 is a section of a modified disc.

In FIG. 5, an alternative hollow disc 129 is shown which is made from two plates 129A and 129B which plates each have one side tapered to an approximate parabolic curve similar to half a conventional turbine rotor disc. The two plates are welded or brazed at their outer perimeters to a band or hoop 131 and their inner perimeters to a hub ring 133. The fences are omitted in this Figure.

During use, fluid such as steam or gas enters inlets 7 into the plenum 2 surrounding nozzle 20 and circulates in the plenum in the direction of rotor rotation. The fluid then enters nozzle 20 through the convergent-divergent throats in nozzle 28 formed by segments 25. The motivating fluid next enters the openings between neighboring discs 29 of both portions 10A and 10B. The disc's outer edges can be uninterrupted or plain as shown in FIG. 4 or can be serrated as shown in FIG. 6.

Figure 6:
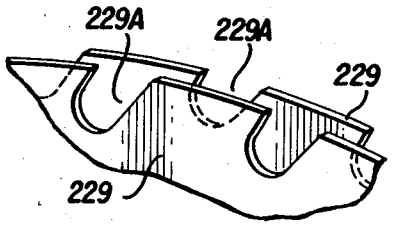
FIG. 6 is a section of two neighboring discs with modified outer edges.

In FIG. 6, the discs 229 have serrated openings 229A which are offset from the openings of neighboring discs. This structure prevents undesirable losses due to poor fluid entry into the disc pack from the nozzle 20 and torque is increased. Fluid leakage at the rotor ends is also reduced because fluid cross-flow is prevented.

Fluid in the disc pack is guided by the fences 33, which afford additional surfaces for fluid motivation, the fluid exiting through passageways 35A and 35B in opposite directions.

In my copending application filed of even date and titled "Multi Stage Turbine" convergent-divergent nozzles with adjustable throats are described and the disclosure of the adjusting structure best seen in FIG. 7 of that application is incorporated by reference herein.

Although specific structures have been disclosed herein, onvious variations will occur to those skilled in the art without departing from the principals of the invention. Accordingly, I do not wish to be limited to the specific embodiments described above except as indicated in the claims.

What is claimed is:

1. A turbine including a casing and a rotor journalled for rotation in said casing, said rotor being circular and fitted within the casing to leave a plenum around the outer rotor circumference, fluid entry means into said plenum and nozzle means located adjacent said outer circumference, said rotor comprising a pack of spaced-apart discs that define fluid entry means in said circumference, central exhaust holes in said discs that form unobstructed fluid exhaust exits at opposite sides of said rotor, said pack comprising two portions that are separated by a central solid disc that divides the flowing fluid into two oppositely flowing exhaust streams, said pack portions being connected to respective drive shafts at opposite sides of said casing.

2. The turbine of claim 1, wherein said nozzle means substantially spans the entire width of said disc pack.

3. The turbine of claim 1, wherein said nozzle means comprises nozzles that are convergent-divergent in configuration and said nozzles are secured to said casing to closely surround the rotor circumference.

4. The turbine of claim 1, wherein said shafts have inner ends that terminate adjacent the outer sides of said disc pack portions, the outer end discs of said portions comprising support members with apertured hubs that are connected to said shafts.

5. The turbine of claim 1, wherein the outer edges of the discs are serrated and the serrations of adjacent discs are relatively off-set from one another.

6. The turbine of claim 1, wherein at least one of said discs is hollow and comprises two serrated plates, each circular plate having an outer tapered parabolic surface, the outer edges of said plates being interconnected by a circular band and the inner edges of said plates being interconnected by a hub ring.

7. A turbine including a casing and a rotor journalled for rotation in said casing, said rotor being circular and fitted within the casing to leave a plenum around the outer rotor circumference, fluid entry means into said plenum and nozzle means located adjacent said outer circumference, said rotor comprising a pack of spaced-apart discs that define fluid entry means in said circumference, central exhaust holes in said discs that form unobstructed fluid exhaust exits at opposite sides of said rotor, said pack comprising two portions that are separated by an intervening member that divides the flowing fluid into two oppositely flowing exhaust streams, said pack portions having unobstructed centers and the outer sides of the pack portions being connected to respective drive shafts located at opposite sides of said casing.

8. The turbine of claim 7, wherein said shafts have inner ends that terminate adjacent the outer sides of said disc pack portions, said intervening member being substantially fluid impervious at the center of the rotor.

9. The turbine of claim 8, wherein said discs are separated by internal fences that define fluid paths through said packs.

10. The turbine of claim 9, wherein said fences are curved and interconnect the discs to one another.

* * * * *